United States Patent [19]

O'Farrell et al.

[11] 4,117,186

[45] Sep. 26, 1978

[54] BUTYL/RESIN BLEND LATEX USED TO COAT POLYPROPYLENE FABRICS

[75] Inventors: Charles P. O'Farrell, Clark; Paul L. Malloy, Westfield; Francis M. Thompson, White House Station, all of N.J.

[73] Assignee: Exxon Research & Engineering Co., Linden, N.J.

[21] Appl. No.: 766,704

[22] Filed: Feb. 8, 1977

Related U.S. Application Data

[63] Continuation-in-part of Ser. No. 609,811, Sep. 2, 1975, abandoned, which is a continuation of Ser. No. 482,246, Jun. 24, 1974, abandoned.

[51] Int. Cl.[2] ..... B32B 25/08; B32B 25/10; B32B 25/18; B32B 27/32

[52] U.S. Cl. ..... 428/265; 260/29.7 B; 260/29.7 UA

[58] Field of Search ..... 428/265; 260/29.7 B, 260/29.7 UA

[56] References Cited

U.S. PATENT DOCUMENTS

| | | | |
|---|---|---|---|
| 3,243,390 | 3/1966 | Hillard et al. | 260/29.7 UA |
| 3,703,197 | 11/1972 | Samler | 428/265 |
| 3,867,247 | 2/1975 | Farrell et al. | 428/265 |
| 3,885,077 | 5/1975 | Lederman | 428/265 |

FOREIGN PATENT DOCUMENTS

| | | | |
|---|---|---|---|
| 1,248,731 | 10/1971 | United Kingdom | 428/265 |

OTHER PUBLICATIONS

C.A. 87, 86074h (1977).

*Primary Examiner*—J. C. Cannon
*Attorney, Agent, or Firm*—Henry E. Naylor; Harvey L. Cohen

[57] ABSTRACT

Improved butyl rubber-hydrocarbon resin latex compositions are prepared by emulsifying a solution of butyl rubber and a hydrocarbon resin in a one-step process wherein the emulsifying agent is the sodium salt of the sulfate ester of nonylphenoxypoly(ethyleneoxy) ethanol. The films formed therefrom exhibit improved properties over compositions prepared from blends of latices of butyl rubber and hydrocarbon resins.

3 Claims, No Drawings

BUTYL/RESIN BLEND LATEX USED TO COAT POLYPROPYLENE FABRICS

CROSS-REFERENCE TO RELATED APPLICATIONS

This application is a Continuation-in-Part of application Ser. No. 609,811, filed Sept. 2, 1975, now abandoned, which in turn is a continuation of Ser. No. 482,246 filed June 24, 1974, now abandoned.

BACKGROUND OF THE INVENTION

It is well known in the art to prepare latices of butyl rubber. See, for example, U.S. Pat. Nos. 3,644,263 and 3,719,572. Various latices of butyl rubber and resins have been prepared as emulsion type compositions. These compositions, however, use a hydrogenated resin and no preference is taught for either blending emulsions of the butyl rubber and the hydrogenated resin or preparing emulsions of the blend of butyl rubber and a hydrocarbon resin with a specific emulsifier. See, for example, U.S. Pat. No. 3,243,390.

SUMMARY OF THE INVENTION

It has surprisingly been found that improved compositions may be prepared from butyl rubber and hydrocarbon resins by preparing a solution blend of an unhydrogenated hydrocarbon resin and butyl rubber and thereafter emulsifying the blend with the sodium salt of the sulfate ester of nonylphenoxypoly(ethyleneoxy) ethanol to prepare a latex. The latex has improved physical properties as well as improved adhesion to polypropylene fibers. The critical aspect of the invention is the use of an unhydrogenated aliphatic hydrocarbon resin as well as the specific emulsifier as indicated above.

DETAILED DESCRIPTION OF THE INVENTION

This invention relates to a composition comprising an emulsified blend of butyl rubber and a hydrocarbon resin. More particularly, it refers to a composition comprising a blend of butyl rubber and a hydrocarbon resin which is emulsified to produce a latex of the blend of rubber and resin. The term "butyl rubber" as used in the specification and claims is intended to include copolymers made from a polymerization reactant mixture having therein about 70–99.5% by weight of an isoolefin which has about 4–7 carbon atoms and about 30–0.5% by weight of a conjugated multiolefin having about 4–14 carbon atoms. The resulting copolymer contains 85–99.5% of combined isoolefin and 0.5 to 15% by combined multiolefin. The term "butyl rubber" is described in an article by R. M. Thomas et al in Industrial Engineering and Chemistry, vol. 32, pp. 1283 et seq., October, 1940.

The butyl rubber generally has a viscosity average molecular weight between about 200,000 to about 600,000; preferably about 300,000 to about 500,000; especially 350,000 to 450,000; and a Wijs iodine number of about 0.5 to about 50; preferably 1 to 15. The preparation of butyl rubber is described in U.S. Pat. No. 2,356,128, which is incorporated herein by reference.

The unhydrogenated hydrocarbon resins suitable for use in the practice of this invention are derived from the polymerization of aliphatic hydrocarbon residues obtained from the catalytic cracking distillation or thermocracking of petroleum oils.

The aliphatic petroleum hydrocarbon resins suitable for use in the practice of this invention are derived from a mixture of monomers having an average molecular weight of about 90 and composed of dienes and olefins. The resins prepared from these monomers are a mixture of straight chain hydrocarbon resins having incorporated in their structure cyclic moieties but no aromatic nuclei. Typically, the resins have a molecular weight of about 800 to 1500, an iodine number (Wijs) of about 145, and a ball and ring melting point range of about 70° to about 100° C. The resins have an aniline point of at least 100° C.

It is a critical aspect of the invention that the hydrocarbon resins to be used must be in their unhydrogenated state. Although the hydrogenated resins exhibit better color and stability in some respects, hydrogenation results in inferior properties. Additionally, it is a critical aspect of this invention that the hydrocarbon resin and butyl rubber must be blended in solution prior to emulsification. To this extent, the compositions of this invention are distinguished from prior art blends which comprise the blend of butyl rubber latices with latices of a hydrocarbon resin.

In the preparation of the latices of this invention, the rubber and resin are dissolved in a suitable solvent. The preferred solvents are hydrocarbon solvents, and in particular aromatic solvents. Illustrative of these aromatic solvents are toluene, xylene, benzene, ethylbenzene, etc. Halogenated aromatic solvents such as chlorobenzene are also suitable.

The solution generally contains from about 20 to about 50 wt. % total rubber and resin based on the total solution of solvent, rubber and resin, preferably about 30 to 45%. The concentration of rubber and resin in the solvent is not critical except to the extent that low concentrations are uneconomical and higher concentrations result in highly viscous, hard-to-work solutions.

The weight ratio of rubber to resin is about 4:1 to about 0.8:1; preferably about 2:1 to about 0.8:1; more preferably about 1:1.

Although the methods of emulsification of the present rubber/resin/solvent systems are not novel the specific emulsifier used to produce these compositions is. It is critical to the instant invention that the sodium salt of the sulfate ester of nonylphenoxypoly(ethyleneoxy) ethanol comprising four moles of ethylene oxide be used. Although other conventional emulsifiers may give an oil in water emulsion, unexpected results such as increased mechanical stability during processing and in the final latex are obtained by using the aforementioned sodium salt. The emulsifier is used at a concentration of about 0.5–5% by weight of the total rubber and resin. The emulsion is first prepared by emulsifying the solvent/rubber/resin solution into water and thereafter mechanically working in a dispersator. The emulsion is stripped of solvent to prepare a finished latex. The advantages of the instant invention may be more readily appreciated by reference to the following examples.

EXAMPLE 1

To 1300 grams of toluene were added 350 grams of Butyl 278 rubber and 350 grams of Piccopale 100 resin. The mixture was stirred overnight to produce a homogeneous solution. 800 grams of this solution were mixed by hand with 535 grams of distilled $H_2O$ and 47 grams of Alipal CO-433 (31% active). The mixture was then emulsified on a dispersator using the following cycle: 5 min at 40 volts open, 5 min at 110 volts open, 5 min at 110 volts closed. The emulsion (av. particle size 3μ) was then stripped of solvent on a Rotovac to 47.3 wt. % solids. The finished latex showed good latex properties, i.e., small particle size <1μ and low viscosity, 100 cps.

Butyl 278 is a butyl rubber comprising isobutylene and isoprene having a Mooney Viscosity (ML 1+3 (260° F.)) of about 50 to 60, a mole percent unsaturation of about 1.5 and a viscosity average molecular weight of about 450,000.

Piccopale 100 is an aliphatic petroleum hydrocarbon resin having a molecular weight of about 1200, an aniline point of >100° C., a ball and ring softening point of 100° C., and a Wijs iodine number of 145.

EXAMPLE 2

Butyl 278 in toluene 332 lbs. (23.2 wt. % solids), 77 lbs. of polymer were added to the emulsification tank in the pilot unit. 77 lbs. of Piccopale 100 resin dissolved in 150 lbs. of toluene were then added to this tank and the butyl/resin solutions were mixed together. 288 lbs. of water containing 25.7 lbs. of Alipal CO-433 (28% active) and 1.3 lbs. of $NaH_2PO_4$ were then added to the polymer cement and stirred in. The raw emulsion was made by passing the crude emulsion through a shear pump four times at settings of 6.5, 8.5, 8.5, 8.5, respectively. Final reduction in particle size was attained by passing the emulsion through a sonolator (2 times) at 500 psi. The raw emulsion was then stripped to produce 50 gal. of a finished latex of 63.5 wt. % solids.

Butyl latex is normally mixed with resin latex to attain a desirable balance of properties. The data shown in Table I shows that an emulsified blend prepared in the manner of this invention is superior to the admixed blend of latices.

Table I

| Latex | Butyl 278/ Piccopale 100 Emulsified Blend (Example #2) 50/50 | Admixed Blend of Butyl Latex and Piccopale A-55 50/50 Blend |
|---|---|---|
| Wt. % Solids | 64 | 60 |
| Solution Viscosity Brookfield #3 spindle, 12 rpm 24° C., cps | 1800 | — |
| Particle Size, | | |
| Average | <1 | 1 |
| Largest | 3 | 5 |
| Mechanical Stability (19,000 rpm, 30 min RT) | | |
| Volume Increase | 200 | 100 |
| % Coagulum | 0 | 2.2 |
| Physical Properties (Cast Film) | | |
| 100% Modulus | 110 | 45 |
| Tensile Strength | 95 | 30 |
| % Elongation | 2000+ | 2000+ |
| Film Appearance | excellent | good |

EXAMPLE 3

To a toluene cement containing 250 g of butyl rubber and 1315 g of toluene was added 250 g of a hydrogenated aliphatic resin, bromine number (cgm/gm) = 1. To this cement phase was then added 1815 g of $H_2O$ containing 85.7 g of Alipal CO-433 (29.1% active). A raw emulsion was formed by simple stirring and the particle size of the raw emulsion was reduced in a dispersator at the following settings: 5 min at 40 volts open, 5 min at 110 volts open, and 5 min at 110 volts closed. The raw emulsion was then stripped of excess solvent and $H_2O$ on a Rotovac. The properties of the coemulsified blend were: 53.5 wt. % solids, pH — 6.4, solution viscosity (Brookfield LVT, #3 spindle, 12 rpm at 24° C.) = 420 cps.

The hydrogenated aliphatic resins used in this experiment have a Gardner color of 1, a softening point of 85° C., a specific gravity of 1.10, a bromine number of 1, and a Brookfield viscosity (cps) (70% in toluene) of 100.

EXAMPLE 4

A sample of a coemulsified blend of butyl rubber and an unhydrogenated resin [Bromine number (cgm/gm) = 30] prepared as described in Example 1 was compared with a hydrogenated resin coemulsified blend as prepared in Example 1. Both coemulsified blends were adjusted so as to contain butyl/resin ratio of 60/40 wt. % by addition of butyl latex. The coemulsified blends were then simply formulated by reducing the solids content of both latices to 20 wt. % solids by addition of $H_2O$ and adjusting the solution viscosity with 3 wt. % Hercules 7H4 to 1500 cps. Films of the latices were cast on glass plates, allowed to air dry for 24 hrs and then vacuum dried at 50° C. for 16 hours. The properties of the cast latex film are given in the following Table II.

Table II

| Sample | Butyl/ Unhydrogenated Resin | Butyl/ Hydrogenated Resin |
|---|---|---|
| Polyken Tack Test (Dwell = 1 sec, speed = Km/sec) | 75 gm/cm² | 88 gm/cm² |
| Shore "A" Hardness | 55 | 35 |
| Physical Properties of Cast Film (Instron, 50"/min at 24° C)* | | |
| 100 % Modulus, psi | 140 | 65 |
| 300 % Modulus, psi | 150 | 70 |
| 500 % Modulus, psi | 170 | 75 |
| Tensile Strength, psi | 365 | 85 |
| % Elongation | 1800 | 2500 |

*Sample pulled at high crosshead speed to maximize effect of crosslinking.

This example clearly shows that improved physical properties can be obtained by using an unhydrogenated resin which can develop crosslinks during drying vs. a hydrogenated coemulsified blend counterpart. The unhydrogenated blend also gives harder, drier films.

EXAMPLE 5

300 grams of butyl rubber and 200 grams of an unhydrogenated resin [Bromine number (cgm/gm) = 30] were dissolved in 1575 grams of toluene. Three 415 gram portions of this cement were contacted with equal weights of deionized water containing 6 phr of emulsifier. The three emulsifiers tested were (a) dodecyl sodium sulfate; (b) nonylphenoxypoly (ethyleneoxy) ethanol containing 6 moles of ethylene oxide; (c) sodium salt of the sulfate ester of nonylphenoxypoly (ethyleneoxy) ethanol containing 4 moles of ethylene oxide. The cement phase, in each instance, was contacted with the water phase containing surfactant. Each crude emulsion was refined (i.e., particle size reduced) in a Gifford Wood Homomixer under the following conditions: 5 minutes at 40 V open, 5 minutes at 40 V closed, and 5 minutes at 110 V closed. The raw emulsions and the stripped, finished latexes exhibited the following properties.

TABLE III

| Emulsifier: | (a) | (b) | (c) |
|---|---|---|---|
| Appearance of Crude Emulsion | Homogeneous Avg. Particle Size <1μ | Inverted Water in Oil Emulsion | Homogeneous Avg. Particle Size <1μ |

TABLE III-continued

| Emulsifier: | (a) | (b) | (c) |
|---|---|---|---|
| Mechanical Stability[1] (19,000 rpm at 82° C) | | | |
| % Coagulum | 2.7 | — | 0.05 |
| Finished Latex | | | |
| Total Solids, wt% | 48.9 | — | 56.8 |
| pH | 7.3 | | 6.8 |
| pH Stability | >7 | | 2–11 |
| Mechanical Stability (19,000 rpm at R.T.) | | | |
| % Coagulum | 6.5 | — | 0 |

[1]Latex is sheared in a Hamilton Beach mixer for 30 min. The sheared latex is filtered through a 325 mesh screen and the coagulum measured.

The above data clearly show that the sodium salt of a sulfated nonylphenoxypoly (ethyleneoxy) ethanol comprising 4 moles of ethylene oxide, surfactant *c*, produces an artificial, coemulsified latex with superior mechanical stability. This property allows one to produce a coemulsion of butyl rubber and unhydrogenated hydrocarbon resin in a solvent removal process efficiently and does not give rise to excess coagulum during stripping or in the final product. This anionic emulsifier which exhibits nonionic characteristics, i.e., pH stable, stabilizes both polymeric components in this high solids finished coemulsified latex over a broad pH range thereby allowing greater compounding latitude in final usage.

EXAMPLE 6

Woven polypropylene fabric was coated with the formulated butyl/resin coemulsified blend latices described in Example 4. This was accomplished by dipping the fabric in the latex solutions and running the fabric through a padder roll with the roll pressure adjusted to control the coating add-on to about 8% (by weight). The coated fabric was dried at 275° F for 3 minutes. Testing of the fabrics coated with the respective coemulsified blends gave the following results:

TABLE IV

| | Butyl/Unhyrdogenated Resin | Butyl Hydrogenated Resin |
|---|---|---|
| Tensile at Break of 1" × 6" sample (Instron 20"/min) psi | 118 | 106 |
| Ribbon Adhesion of 3" × 6" sample, Adhesion, lbs (warp direction) | 70 | 60 |

The data clearly shows that a coemulsified blend of butyl and unhydrogenated resin gives a tougher, more desirable binder for PP than its hydrogenated counterpart.

The ribbon adhesion test measures the peak force and the total energy required to pull six three-inch ribbons from the ends of eight to thirty 6-inch ribbons. The actual number of 6-inch ribbons depends on the tightness of the weave of the ribbon fabric. For convenience, the test samples are cut from the fabric samples using a 3 × 6 inch die. The test is run on an Instron using a three-pronged claw which drags the six short ribbons from the long ribbons.

What is claimed is:

1. A woven polypropylene fabric having adhered thereto a coating consisting essentially of a latex of butyl rubber and an unhydrogenated aliphatic petroleum hydrocarbon resin prepared from a coemulsified solution blend of said rubber and resin, wherein the weight ratio of rubber to resin is about 4:1 to 0.8:1 and wherein said resin has an aniline point greater than 100° C.

2. The composition of claim 1 wherein the weight ratio is about 2:1 to 0.8:1.

3. The composition of claim 1 wherein the weight ratio is 1:1.

* * * * *